US005411849A

United States Patent [19]

Hasegawa

[11] Patent Number: 5,411,849

[45] Date of Patent: May 2, 1995

[54] SILVER HALIDE PHOTOGRAPHIC LIGHT-SENSITIVE MATERIAL

[75] Inventor: Takuji Hasegawa, Hino, Japan

[73] Assignee: Konica Corporation, Tokyo, Japan

[21] Appl. No.: 162,674

[22] Filed: Dec. 6, 1993

[30] Foreign Application Priority Data

Dec. 10, 1992 [JP] Japan ..... 4-330652

[51] Int. Cl.[6] ..... G03C 1/005; G03C 1/08

[52] U.S. Cl. ..... 430/567; 430/569; 430/627; 430/628; 430/642

[58] Field of Search ..... 430/567, 569, 627, 628, 430/642

[56] References Cited

U.S. PATENT DOCUMENTS

| | | | |
|---|---|---|---|
| 2,525,753 | 10/1950 | Yutzy et al. | 430/642 |
| 2,592,250 | 4/1952 | Davey et al. | 430/569 |
| 2,614,928 | 10/1952 | Yutzy et al. | 430/569 |
| 2,691,582 | 10/1954 | Lowe et al. | 430/628 |
| 3,505,068 | 4/1970 | Beckett et al. | 430/567 |
| 3,574,628 | 4/1971 | Jones | 430/567 |
| 3,655,394 | 4/1972 | Illingsworth | 430/569 |
| 4,210,450 | 7/1980 | Corben | 430/567 |
| 4,288,535 | 9/1981 | Kanisawa et al. | 430/569 |
| 4,414,310 | 11/1983 | Daubendiek et al. | 430/567 |
| 4,434,226 | 2/1984 | Wilgus et al. | 430/567 |
| 4,444,877 | 4/1984 | Koitabashi et al. | 430/567 |
| 4,999,282 | 3/1991 | Sato et al. | 430/627 |

*Primary Examiner*—Charles L. Bowers, Jr.
*Assistant Examiner*—Mark F. Huff
*Attorney, Agent, or Firm*—Frishauf, Holtz, Goodman & Woodward

[57] ABSTRACT

A silver halide photographic light-sensitive material comprising a support having thereon a silver halide emulsion layer containing a silver halide emulsion comprising silver halide grains, which is prepared by a process comprising (i) forming the silver halide emulsion by mixing a silver salt and a halide salt in a dispersion medium, (ii) subjecting the emulsion formed to washing to remove water-soluble salts, and then (iii) carrying out chemical sensitization of the emulsion wherein in (ii), the washing is carried out by coagulating the emulsion by a gelatin coagulant selected from of a modified gelatin or a polymeric coagulant represented by the following formula [I]; and in (iii), iodide-containing silver halide fine grains are added at a time during the course of the chemical sensitization, formula [I]

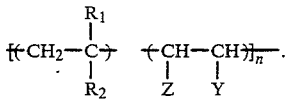

.

5 Claims, No Drawings

SILVER HALIDE PHOTOGRAPHIC LIGHT-SENSITIVE MATERIAL

FIELD OF THE INVENTION

This invention relates to a silver halide photographic light-sensitive material improved in the abrasion resistance and drying speed in making a rapid processing thereof and having blue-black tone of developed silver without having any yellowish tint.

BACKGROUND OF THE INVENTION

In the field of radiographic photographic materials recently, a processing time has been shortened with advances of a high-temperature and rapid processing techniques. The elemental techniques for a rapid processing include, for example, the improvements in the developability and fixability of a silver halide photographic light-sensitive material and the drying speed after a washing treatment.

In a photographic light-sensitive material, on the other hand, it has been inevitable to increase a covering power in order to save a silver content necessary for obtaining a given optical density and improve a sensitivity and develop property. For obtaining a high covering power, many proposals have so far been made for an radiographic photographic light-sensitive material. For example, Japanese Patent Publication Open to Public Inspection (hereinafter referred to as JP OPI Publication) Nos. 61-116347/1986 and 57-182732/1982 disclose each for reducing the gelatin content of the component layers of a light-sensitive material and U.S. Pat. No. 3,271,158 discloses for making use of a polymer such as polyacryl amide.

In recent years, it has been well-known in the art that, when making use of tabular-shaped silver halide grains, a color-sensitization efficiency and a covering power can be increased and a sharpness can also be improved. As for the tabular-shaped grains, those having an aspect ratio of not less than 8 are disclosed in, for example, JP OPI Publication Nos. 58-113926/1983, 58-113927/1983 and 58-113928/1983.

However, each of the techniques has such a serious defect that, when reducing a gelatin content that is a component of a binder, a proportion of silver/gelatin is made higher so that an abrasion-fog may easily be produced in handling or transporting a film and such a trouble as that a drying speed may also be slowed down when making use of a polymer.

Further in these techniques, a developed silver tone is tinted with yellow.

For a direct observer of the silver image produced on a photographic light-sensitive material for medical use, a silver image having a blue-black tone is preferable and a yellowish tint is disliked by him because the yellowish tint gives him a disagreeable feeling.

There have so far been the Well-known measures to counter an abrasion trouble including, for example, a measure in which a water-soluble polyester is used in a layer such as described in JP OPI Publication No. 64-29834/1989, a measure in which a polyhydroxybenzene is used such as described in JP OPI Publication No. 62-21143/1987 and a measure in which a specific organic compound having an adsorption group to a silver halide such as described in JP OPI Publication No. 4-177336/1992. However, these techniques have also been not only satisfactory for preventing an abrasion-fog production, but also not preferable from the viewpoint of a silver tone.

SUMMARY OF THE INVENTION

It is accordingly an object of the invention to provide a silver halide photographic light-sensitive material having a high sensitivity and capable of preventing an abrasion-fog produced when handling or processing a film.

Another object of the invention is to provide a silver halide photographic light-sensitive material having a blue-black tone, without deteriorating a drying speed even when a rapid processing is carried out through an automatic processor and without yellowish-tinting a developed silver.

The present invention can be achieved with a silver halide photographic light-sensitive material comprising a support provided at least one side of said support with a silver halide emulsion layer containing a silver halide characterized in that said silver halide emulsion comprises silver halide grains coagulated at least once by a high molecular cohering agent when preparing said emulsion and that silver halide fine grains having an average grain volume smaller than that of said silver halide grains and having a silver iodide content more than that of said silver halide grains, said silver halide fine grains are added to said silver halide emulsion at a time during the course of chemical sensitization of said silver halide emulsion.

DETAILED DESCRIPTION OF THE INVENTION

The silver halide fine grains relating to the invention comprise silver iodide, silver iodobromide or silver iodochlorobromide. The silver halide fine grains have a silver iodide content more than the silver halide grains. Among them, silver iodide is particularly preferable.

The silver halide fine grains are preferable to be monodispersive and they are prepared in a double-jet precipitation process, while controlling a temperature, pH and pAg. The average grain size of the silver halide fine grains is not larger than 0.2 μm in sphere equivalent diameter, and, preferably, within the range of 0.01 to 0.1 μm and more preferably, 0.02 to 0.05 μm. The average grain volume thereof is preferable to be smaller than that of an emulsion grain being chemically ripened.

In the invention, silver halide fine grains are added to a parent emulsion at a time during the course of chemical sensitization. The expression, "the course of chemical sensitization", stated herein means a period of time from the point of time when a chemical ripening is started by adding a chemical sensitizer (such as a ripening agent used for a sulfur, gold-sulfur or reduction sensitization) to physically ripened and desalted parent emulsion, to the point of time when the chemical ripening is stopped in reaction. The chemical ripening may be stopped with an ordinary method in which, for example, a temperature, pH or pAg is altered or an inhibitor is added.

When adding the silver halide fine grains of the invention, the temperature of the emulsion is within the range of, 30° C. to 80° C. and, preferably, 40° C. to 65° C.

The silver halide fine grains of the invention may be added in an amount of not more than $1\times10^{-2}$ mols and, preferably within the range of $1\times10^{-6}$ to $2\times10^{-3}$ mols per mol of silver halide of a silver halide emulsion. The silver halide fine grains may also be added several times intermittently. It is further allowed to add another chemically ripened emulsion after adding the silver halide fine grains.

In the preparation of the silver halide emulsion of photographic light-sensitive material relating to the invention, the emulsion is washed by coagulating gelatin at least once with a polymeric coagulant.

Generally, in the preparation steps for a photographic silver halide emulsion, it is usual to carry out a desalting of a physically ripened silver halide emulsion for removing soluble salts such as an alkali or ammonium nitrate salt as well as an excess halide.

The desalting methods include, for example, a noodle method, a dialysis method or a coagulation-precipitation method, of which have been well-known. Among them, the coagulation-precipitation desalting method has widely been put into practice, because it is superior to the other methods.

In the coagulation of gelatin of the invention, it is preferable to use a chemically modified gelatin. The modified gelatin is a gelatin coagulant being a polymeric coagulant capable of coagulating the gelatin together with silver halide grains, and is specifically one in which not less than 50% of the amino groups in the gelatin molecule are treated with a chemical reagent so that a hydrogen atom(s) of the amino group is substituted or replaced by a specific group. The examples of the substitution to the amino groups of gelatin are given in, for example, U.S Pat. Nos. 2,691,582, 2,614,928 and 2,525,753.

The substiting groups include specifically those given below.

(1) An acyl group such as an alkylacyl, arylacyl, acetyl and substituted or unsubstituted benzoyl group;

(2) A carbamoyl group such as an alkylcarbamoyl group and an aryl carbamoyl group;

(3) A sulfonyl group such as an alkylsulfonyl group and an arylsulfonyl group;

(4) A thiocarbamoyl group such as an alkylthiocarbamoyl group and an arylthiocarbamoyl group;

(5) A straight chained or branched alkyl group having 1 to 18 carbon atoms; and (6) An aryl group including a substituted or unsubstituted phenyl, naphthyl or pyridyl group and an aromatic or heterocyclic furyl group.

Among these groups, a preferable modified gelatins are those substituted with an acyl group ($-COR^1$) and a carbamoyl group ($-CON(R^1)(R^2)$). Thus, the amino group ($-NH_2$) of the gelatin is changed to $-NHCOR^1$ or $-NHCON(R^1)(R^2)$ group.

The above-denoted $R^1$ represents a substituted or unsubstituted aliphatic group (such as an alkyl group having 1 to 18 carbon atoms and an allyl group), an aryl group or an aralkyl group (such as a phenethyl group); and $R^2$ represents a hydrogen atom, an aryl group or an aralkyl group. Among them, particularly, $R^1$ and $R^2$ represent preferably an aryl group and a hydrogen atom, respectively.

The modified gelatin is exemplified concretely by representing the substituting groups to the amino groups.

Exemplified Substituting groups to amino groups

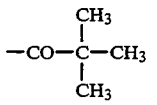
G-1

$-COCH_3$ G-2

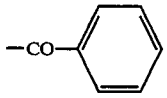
G-3

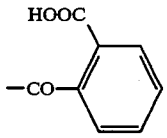
G-4

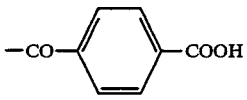
G-5

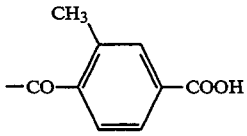
G-6

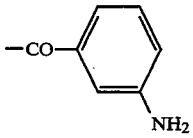
G-7

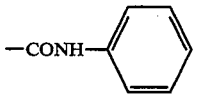
G-8

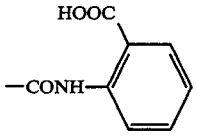
G-9

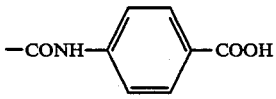
G-10

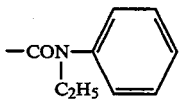
G-11

$-CONHCH_3$ G-12

There is no special limitation to the amount of the modified gelatin to be added for desalting treatment. However, it is suitable to add it in an amount (by weight) 0.3 to 10 times and, preferably, 1 to 5 times as much as gelatin contained as a protective colloid when making a desalting treatment.

The coagulant applicable to the invention further includes a polymeric coagulant represented by the following Formula (I).

Formula (I)

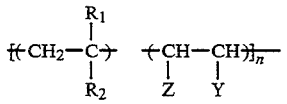

wherein $R_1$ and $R_2$ represent each an alkyl group having 1 to 8 carbon atoms, which may be the same as or different from each other.

Z and Y represent each —COOM group, —$COOR_3$ group or —$CON(R_4)(R_5)$ group.

M represents a hydrogen atom, an alkali metal atom or ammonium group, $R_3$ is an alkyl group having 1 to 20 carbon atoms or an aryl group, and $R_4$ and $R_5$ are each a hydrogen, an alkyl group having 1 to 20 carbon atoms or an aryl group, provided that $R_4$ and $R_5$ may be coupled to each other to form a heterocyclic ring; and n is an integer of 10 to $10^4$, preferably 10 to $10^2$.

In Formula (I), The alkyl groups represented by $R_1$ or $R_2$ have each 1 to 8 carbon atoms and preferably 1 to 5 carbon atoms. These alkyl groups include, for example, a methyl group, an ethyl group, a propyl group, a butyl group and a pentyl group.

These alkyl groups may also have a substituent. $R_3$ represents an alkyl group having 1 to 20 carbon atoms and preferably 1 to 12 carbon atoms. They include, for example, a methyl group, an ethyl group, a butyl group, a pentyl group, a heptyl group, an octyl group and a dodecyl group. They may also have a substituent.

The aryl groups include, for example, a phenyl group. $R_4$ and $R_5$ represent each the alkyl groups synonymous with those represented by $R_3$. The heterocyclic groups formed by coupling $R_4$ to $R_5$ together include, for example, a pyridyl group, a morpholino group and an imidazole group.

The typical examples of the high molecular compounds represented by Formula (I) will be given below.

P-1

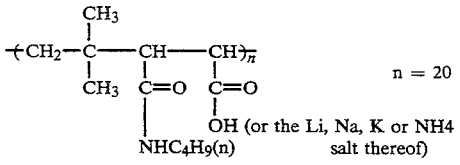

n = 20

P-2

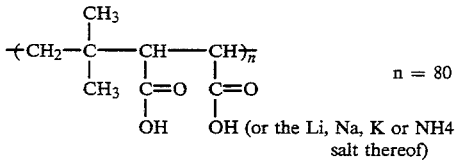

n = 80

P-3

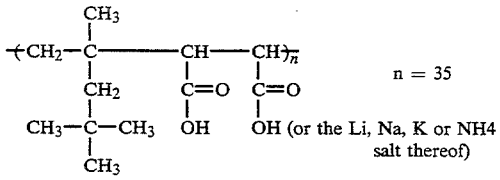

n = 35

P-4

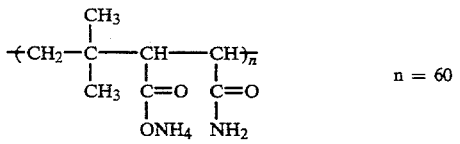

n = 60

-continued

P-5

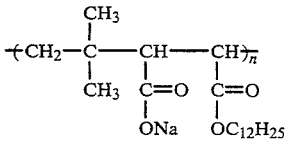

n = 10

P-6

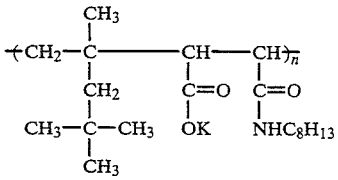

n = 20

P-7

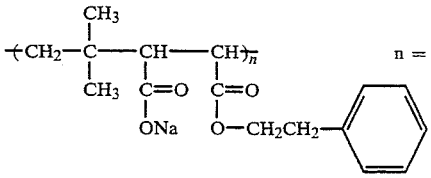

n = 20

P-8

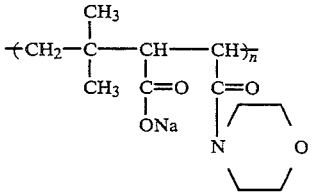

n = 16

P-9

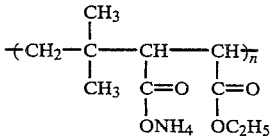

n = 40

P-10

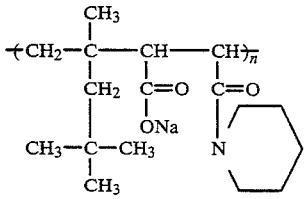

n = 15

The above-mentioned compounds are well known as polymer coagulants and readily available on the market.

The polymer coagulants have each a molecular weight within the range of $10^3$ to $10^6$ and preferably $3\times10^3$ to $2\times10^5$. They are added in an amount by weight within the range of 1/50 to $\frac{7}{8}$ and preferably 1/40 to 1/10 of gelatin contained in an emulsion.

In the embodiments of the invention, after the polymer coagulant is added, the pH thereof is adjusted so as to cause to coagulate the silver emulsion. The pH for coagulating the emulsion is within the range of 2.0 to 5.5 and, preferably, 3.8 to 5.0.

There is no special limitation to an acid applicable to a pH control. However, it is preferable to use an organic acid such as acetic acid, citric acid and salicylic acid and an inorganic acid such as hydrochloric acid, nitric acid, sulfuric acid and phosphoric acid. It is also allowed to make combination use of the coagulant of the invention and a heavy-metal ion such as magnesium ion, cadmium ion, lead ion and zirconium ion.

The desalting treatment may be carried out either once or several times repeatedly. In the latter case, the coagulant may be added every time when a desalting treatment is carried out or may also be added the coagulant at the first time only.

In the emulsion applicable to the invention, the silver halides thereof comprises silver iodobromide, silver iodochlorobromide or the like. Among them, silver iodobromide is preferably used from the viewpoint of attaining a high sensitivity. The silver halide grains may be a crystal form isotropically grown up such as a cube, an octahedron and a tetradecahedron, a polyhedral crystal form such as a sphere, those twin-crystallized having a plane defect or those mixed with or composed of the above-given grains.

An emulsion of the invention can be prepared in any well-known processes including, for example, the process described in "Emulsion Preparation and Types" appeared in Research Disclosure (RD) No. 17643 (December, 1978), pp. 22~23; and the process described in ibid., (RD) No. 18716 (November, 1979), p. 648.

The emulsion of the invention can be prepared in the following processes namely, the process described in T. H. James, "The Theory of the Photographic Process", 4th Ed., Macmillan Press, (1977), pp. 38~104; G. F. Duffin, "Photographic Emulsion Chemistry", Focal Press, (1966); P. Glafkides, "Chemie et Physique Photographique", Paul Montel, (1967); or V. L. Zelikman et al, "Making and Coating Photographic Emulsion", Focal Press, (1964).

To be more concrete, such an emulsion as mentioned above can be prepared under the following conditions, namely, solution conditions such as an acidic process, an ammoniacal process or a neutral process; mixing conditions such as a normal precipitation process, a reversal precipitation process and a double-jet precipitation process; grain preparation conditions such as a conversion process and a core/shell process; and a process combined with the above-mentioned conditions.

The preferable embodiments of the emulsion of the invention includes a monodisperse type emulsion comprising silver halide grains containing internally localized silver iodide localized. The term, "a monodisperse type", herein stated is defined as follows. When an average grain size is determined in an ordinary method, at least 95% (by number or weight) of grains have a grain size within the range of ±40% of the average grain size and, preferably ±30% thereof.

The grain size distribution of a silver halide emulsion may be a polydisperse type having a wide distribution. The crystal structure of silver halide grains may be comprised of the different silver halide compositions between the inside and the outside. For example, it may also be a core/shell type monodisperse emulsion having an apparent double-layered structure in which the core portion of a highly silver iodide content is covered by a shell layer having a low silver iodide content.

The processes for preparing the above-mentioned monodisperse type emulsion have been well-known. For example, the processes are detailed in Journal of Photographic Science, Vol. 12, pp. 242–251, (1963), JP OPI Publication Nos. 48-36890/1973, 52-16364/1977, 55-142329/1980 and 58-49938/1983, British Patent No. 1,413,748, U.S Pat. Nos. 3,574,628 and 3,655,394 and so forth.

As for the emulsion applicable to the silver halide photographic light-sensitive material of the invention, it is also allowed to use an emulsion prepared by making use of a seed crystal and then by supplying silver ion and a halide ion so as to grow the seed crystal, in a process for preparing the above-mentioned monodisperse type emulsion.

The processes for preparing the above-mentioned core/shell type emulsion have been well-known. For example, the processes therefor may be cited to those described in Journal of Photographic Science, Vol. 24, p.198, (1976), U.S. Pat. Nos. 2,592,250, 3,505,068, 4,210,450 and 4,444,877 or JP OPI Publication No. 60-143331/1985.

The emulsion of the invention may comprise tabular-shaped grains having an aspect ratio (a ratio of a grain diameter/a grain thickness) of not lower than 3. As for the advantages of the tabular-shaped grains mentioned above, for example, British Patent No. 2,112,157 and U.S. Pat. Nos. 4,414,310 and 4,434,226 disclose that a spectral sensitization efficiency, an image graininess and an image sharpness can be improved. The emulsion can be prepared in the processes described therein.

The above-described emulsion may be any one of the surface latent image type for forming a latent image on a grain surface, of the internal latent image type for forming a latent image inside a grain and of the type for forming a latent image on the grain surface and inside the grain.

In the stage of carrying out grain formation or a physical ripening treatment, into the emulsion may also be added, for example, a cadmium salt, a lead salt, a zinc salt, a thallium salt, an iridium salt or the complex thereof, a rhodium salt or the complex thereof, and an iron salt or the complex thereof.

In the silver halide photographic light-sensitive material of the invention, a variety of photographic additives may be applied before or after carrying out a physical or chemical ripening step. As for the compounds applicable to such a process as mentioned above, a variety of compounds such as those given in, for example, Research Disclosure Nos. 17643, 18716 and 308119 (December, 1989). The compounds and the pages given in the Research Disclosures will be shown below.

| | RD-17643 | | RD-18716 | RD-308119 | |
|---|---|---|---|---|---|
| Additive | Page | Class | Page | Page | Class |
| Chemical sensitizer | 23 | III | 648 Upper right | 996 | III |
| Sensitizing dye | 23 | IV | 648–649 | 996–8 | IV |
| Desensitizing dye | 23 | IV | | 998 | B |
| Dye stuff | 25–26 | VIII | 649–650 | 1003 | VIII |
| Development accelerator | 29 | XXI | 648 upper right | | |
| Antifoggant· stabilizer | 24 | IV | 649 upper right | 1006–7 | VI |
| Whitening agent | 24 | V | | 998 | V |
| Layer hardener | 26 | X | 651 right | 1004–5 | X |
| Surfactant | 26–27 | XI | 650 right | 1005–6 | XI |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

The supports applicable to the silver halide photographic light-sensitive materials of the invention include, for example, those described in the foregoing RD. Among them, the suitable ones include, for example, those made of a plastic film. The supports may also be provided with a sublayer, subjected to a corona discharge or UV irradiation treatment.

In a method of processing a silver halide light-sensitive material relating to the invention with an automatic processor including a series of developing, fixing, washing (or stabilizing) and drying steps, it is preferable to complete the processing steps from the developing step to the drying step within 90 seconds in total.

Thus, it is to take a time period 90 seconds or less from the point of time when the leading edge of a light-sensitive material is dipped in a developer to the point of time when the leading edge thereof comes out of a drying zone (that is so-called a dry to dry time) and, preferably, the dry to dry time is to be within 60 seconds, more preferably, 20 to 60 seconds.

A developer applicable to the invention has a base containing a 1,4-dihydroxy benzene or, if required, a p-aminophenol type compound and/or a pyrazolidone type compound, as a developing agent.

The 1,4-dihydroxy benzenes include, for example, hydroquinone, chlorohydroquinone, bromohydroquinone, isopropyl hydroquinone, methyl hydroquinone, 2,3-dichlorohydroquinone, 2,5-dichlorohydroquinone, 2,3-dibromohydroquinone, 2,5-dimethyl hydroquinone and a hydroquinone monosulfonate. Among them, hydroquinone is preferred. The p-aminophenol type developing agents include, for example, N-methyl-p-aminophenol, p-aminophenol, N-(β-hydroxyethyl)-p-aminophenol, N-(4-hydroxyphenyl) glycine, 2-methyl-p-aminophenol and p-benzyl aminophenol. Among them, N-methyl-p-aminophenol is preferred.

The pyrazolidone type compounds applicable to the invention include, for example, such a pyrazolidone type compound as 1-phenyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3pyrazolidone.

A developer of the invention also allowed to contain a layer hardener for enhancing a physical layer property upon making hardening reaction with gelatin contained in a light-sensitive material in the course of a development. Such a developer to be contained therein include, for example, glutar aldehyde, β-methyl glutar aldehyde, β-methyl glutar aldehyde, malein dialdehyde, succin dialdehyde, methoxy succine dialdehyde, methyl succin dialdehyde, α-methoxy-β-ethoxy glutar aldehyde, α-n-butoxy glutar aldehyde, α,α-dimethoxy succin dialdehyde, β-isopropyl succin dialdehyde, α,α-diethyl succin dialdehyde, butyl malein dialdehyde or the bisulfite adducts thereof.

In a developer applicable to the invention, a sulfite (such as sodium sulfite and potassium sulfite) may also be used as the preservative for a developing agent.

The additive other than the above-mentioned components applicable thereto include, for example, a development inhibitor such as sodium bromide and potassium bromide, an organic solvent such as ethylene glycol, diethylene glycol, triethylene glycol, dimethyl formamide, methyl cellosolve, hexylene glycol, ethanol and methanol, an antifoggant including a mercapto type compound such as 1-phenyl-5-mercaptotetrazole and sodium 2-mercaptobenzimidazole-5-sulfonate and a benztriazole type compound such as 5-methylbenztriazole. If required, a tone controller, a surfactant, a defoamer and so forth may also be included therein.

The pH of a developer may be within the range of 9.0 to 12 and, preferably, 9.0 to 11.5. As a alkaline or a buffer for setting a pH is contained, for example, a pH controller such as sodium hydroxide, potassium hydroxide, sodium carbonate, potassium carbonate, boric acid, tertiary sodium phosphate and tertiary potassium phosphate.

A developer of the invention may be replenished in an amount of, not more than 330 ml per sq.meter of a light-sensitive material used and, preferably, within the range of 200 ml to 300 ml.

EXAMPLES

The invention will be concretely detailed with reference to the following examples. However, the invention shall not be limited thereto.

EXAMPLE 1

Preparation of Emulsions (1)

Preparation of Seed Emulsions

While the temperature, pAg and pH were kept controlled to be 60° C., pAg=8 and pH=2.0, respectively, monodispersed silver iodobromide cubic-crystal grains were prepared in a double-jet method, having an average grain size of 0.2 μm and an average iodide content of 2 mol%.

The reaction solution (emulsion) containing the resulting grains was divided into three parts and the soluble salts contained therein were removed by a coagulation method as described below, so that three kinds of seed emulsions (T-1, T-2 and T-3) were each prepared.

Method for Desalting T-1

To the reaction solution, an aqueous solution of Demol N (a condensation product of an aldehyde and sodium naphthalene sulfonate) manufactured by Kao-Atlas Co. and magnesium sulfate was added at 40° C. to give a gelatin coagulum, so that a desalting treatment was carried out by decanting the mother liquor. Then, seed grain T-1 was prepared by re-dispersing the coagulum in an aqueous gelatin solution.

Method for Desalting T-2

To the reaction solution, a modified gelatin containing exemplified substituting group G-8 (having an average amino group modification ratio of 92%) as a coagulant was added, at 40° C., in an amount of 38 g/mol of AgX and, after stirring it for 3 minutes, KOH was added (in an amount of 0.13 g/mol of AgX) and the resulting mixture was allowed to stand at a pH of 4.0 and then decanted.

Then, after adding $H_2O$ of 40° C. in an amount of 2.1 liter per mol of AgX, KOH in an amount of 0.25 g/mol of AgX was added and the pH thereof was adjusted to be 5.8. After stirring for 5 minutes, $HNO_3$ (of 1.7N) was added in an amount of 1.5 ml/mol of AgX and the pH thereof was adjusted to be 4.3. After allowing it to stand, a decatation was made. Thereafter, gelatin and KOH (0.2 g/mol of AgX) were each added and the pH thereof was adjusted to 5.8 to redisperse the resulting coagulum, so that Seed Emulsion T-2 was prepared.

Method for desalting T-3

After completing the mixture, Exemplified Compound P-1 as a macromolecule coagulant was added, at 40° C. in an amount of 8.0 g/mol of AgX, to the reaction solution. Thereafter, it was stirred for 3 minutes and KOH (0.13 g/mol of AgX) was added and the pH thereof was adjusted to 4.0. After allowing it to stand, liquid was decanted.

Then, after adding $H_2O$ of 40° C. in an amount of 2.1 liter per mol of AgX, KOH (0.25 g/mol of AgX) was added and the pH thereof was adjusted to 5.8. After stirring for 5 minutes, $HNO_3$ (1.7N) was added in an amount of 1.5 ml/mol of AgX and the pH thereof was adjusted to 4.3. After allowing it to stand, liquid was decanted. Thereafter, gelatin and KOH (0.2 per mol of AgX) were each added and the pH thereof was adjusted to 5.8 to redisperse the resulting coagulum, so that Seed Emulsion T-3 was prepared.

Growth from Seed Emulsions

By making use of the above-mentioned Seed Emulsion T-1, the grains were grown up in the following manner. First, the seed emulsion was dispersed in an aqueous gelatin solution being kept at 40° C. and the pH thereof was adjusted to 9.7 with aqueous ammonia and acetic acid. To the resulting solution, an aqueous ammoniacal silver nitrate solution and an aqueous potassium bromide and potassium iodide solution were each added by a double-jet method. In the course of the addition thereof, the pAg and pH thereof were controlled to be 7.3 and 9.7, respectively, so that a phase having a silver iodide content of 35 mol% was formed. Next, an aqueous ammoniacal silver nitrate solution and an aqueous potassium bromide solution were each added by a double-jet method. The pAg thereof was kept at 9.0 until the grain size was grown to be 95% of the final grain size and the pH thereof was continuously varied from 9.0 to 8.0. Thereafter, the pAg was adjusted to 11.0 and, while keeping the pH thereof at 8.0, the grain size was grown up to become the final grain size. Subsequently, the pH was lowered down to 6.0 with acetic acid and sodium 5,5'-dichloro-9-ethyl-3,3'-di-(3-sulfopropyl)oxacarbocyanine anhydride was added in a proportion of 400 mg/mol of AgX. After desalting treatment was carried out with the foregoing aqueous Demol N solution and an aqueous magnesium sulfate solution, an aqueous gelatin solution was added to the resulting coagulum, so that the mixture was redispersed.

In the above-described procedures, monodisperse type silver iodobromide emulsions (A-1), (B-1) and (C-1) each were prepared, having an average grain sizes (r) of 0.40 μm, 0.65 μm and 1.00 μm, a variation coefficient ($\sigma/r$) of 0.17, 0.16 and 0.16 (wherein $\sigma$ represents standard deviation of the grain size distribution), and an average silver iodide content of 2.0 mol%. The emulsion crystals took a tetrahedral form having roundish corners.

In the same manner as described above, silver iodobromide emulsions (A-2), (B-2) and (C-2) were each prepared by growing them up from seed grain emulsion T-2, except that desalting was carried out with the use of the foregoing modified gelatin as in seed emulsion T-2. Silver iodobromide emulsions (A-3), (B-3) and (C-3) were each prepared by growing them up from seed grain emulsion T-3 in the same manner as in emulsions (A-1), (B-1) and (C-1), except that desalting was carried out by using the coagulant P-1 as in seed emulsion T-3.

Preparation of Emulsions (2)

Preparation of Seed Emulsions

To an aqueous 0.05N potassium bromide solution containing hydrogen peroxide-treated gelatin, which was being vigorously stirred at 40° C., an aqueous silver nitrate solution and an equimolar aqueous potassium bromide solution containing hydrogen peroxide-treated gelatin were each added by a double-jet method. Over a period by 30 minutes from 1.5 minutes after the start of addition, the temperature of the reaction solution was lowered down to 25° C. Thereto, aqueous 28% ammonia was added in an amount of 80 ml/mol of silver nitrate and the mixture thereof was kept stirred for 5 minutes. Thereafter, the pH of the resulting reaction solution was adjusted to 6.0 and the reaction solution was divided into three parts. Each of the parts was desalted in the same manner as in (T-1), (T-2) and (T-3), respectively, so that 3 kinds of seed emulsions (T-4, T-5 and T-6) were prepared, respectively.

Growth from Seed Emulsions

By making use of the above-described seed emulsion T-4, the grains were grown in the following manner. To an aqueous solution containing ossein gelatin and sodium propyleneoxy-polyethyleneoxy disuccinate, an aqueous potassium bromide and potassium iodide solution and an aqueous silver nitrate solution were each added by a double-jet method while stirring vigourously at 75° C. In the course of adding them, the pH and pAg thereof were kept at 5.8 and 9.0, respectively. After completing the addition, the pH of the mixture was adjusted to 6.0 and sodium 5,5'-dichloro-9-ethyl-3,3'-di-(3-sulfopropyl)oxacarboxy cyanine anhydride was added in an amount of 400 mg/mol of AgX. Further, at 40° C., a desalting treatment was carried out by making use of an aqueous Demol (manufactured by Kao-Atlas Co.) N solution and an aqueous magnesium sulfate solution, and then an aqueous gelatin solution was added thereto, so that the mixture was redispersed.

In the above-mentioned procedures, there was prepared a tabular-shaped silver iodobromide grain emulsion (D-1) having an average silver iodide content of 1.5 mol%, a circle-equivalent diameter of 0.96 μm, a variation coefficient of 0.25 and an aspect ratio (a ratio of a diameter to a thickness of grain) of 4.0.

A silver iodobromide tabular grain emulsion (D-2) was prepared by growing it from seed emulsion T-5 in the same manner as in the emulsion (D-1), except that desalting treatment was carried out by using the same modified gelatin derivative as used in the preparation of the emulsion (T-2). A silver iodobromide tabular grain emulsion (D-3) was prepared by growing it from seed emulsion T-6 in the same manner as in the emulsion (D-1), except that desalting treatment was carried out by using the same compound (P-1) as in emulsion (T-3).

Preparation of Samples

To each of the resulting emulsions (A-1, 2 and 3), (B-1, 2 and 3), (C-1, 2 and 3) and (D-1, 2 and 3), sodium 5,5'-dichloro-9-ethyl-3,3'-di-[3-(sulfopropyl)oxacarbocyanine anhydride and sodium 5,5'-di-(butoxycarbonyl)-1,1'-diethyl-3, 3'-(4-sulfobutyl)benzimidazolocarboxycyanine anhydride were added, at 55° C., in an amount of 980 mg/mol of AgX to (A-1, 2 and 3), 600 mg/mol of AgX to (B-1, 2 and 3), 390 mg/mol of AgX to (C-1, 2 and 3) and 500 mg/mol of AgX to (D-1, 2 and 3), respectively in a ratio by weight of 200:1.

After 10 minutes, a chemical ripening treatment was carried out by adding the suitable amounts of sodium thiosulfate and ammonium thiocyanate. Twenty minutes before completing the ripening treatment, silver iodide fine grain emulsion was added thereto in an amount of $5\times10^{-4}$ mols/mol of AgX. Thereafter, 4-hydroxy-6-methyl-1,3,3a,7-tetrazaindene was added in an amount of $3\times10^{-3}$ mols/mol of AgX and the resulting mixture was dispersed in an aqueous solution containing 70 g of gelatin. The silver iodide fine grain emulsion, which has an average grain size of 0.05 μm and is comprised of a mixture of β and γ types, was prepared with double jet method while maintaining pAg of 9.7 at 40° C.

Among the 8 kinds of the chemically-ripened emulsions; (A-1), (B-1) and (C-1) were mixed together in a proportion of 10:70:20 and the resulting emulsion was named Emulsion-I; (A-2), (B-2) and (C-2) were mixed together in the same proportion as above and the resulting emulsion was named Emulsion-II, and (A-3), (B-3) and (C-3) were mixed together in the same proportion as above and the resulting emulsion was named Emulsion-III. (D-1) was independently named Emulsion-IV, (D-2) was named Emulsion-V and (D-3) was named Emulsion-VI, respectively.

To each of Emulsions-I through VI, the following additives were added. The amounts added thereto are indicated by an amount per mol of AgX.

| | |
|---|---|
| 1,1-dimethylol-1-bromo-1-nitromethane | 70 mg |
| t-butyl-catechol | 400 mg |
| Polyvinyl pyrrolidone (having a molecular weight of 10,000) | 1.0 mg |
| A styrene-maleic anhydride copolymer | 2.5 g |
| Nitrophenyl-triphenyl phosphonium chloride | 50 mg |
| 2-anilino-4,6-dimercaptotriazine | 60 mg |
| Ammonium 1,3-dihydroxybenzene-4-sulfonate | 4 g |
| Sodium 2-mercaptobenzimidazole-5-sulfonate | 15 mg |
| $C_4H_9OCH_2CH(OH)CH_2N(CH_2COOH)_2$ | 1 g |
| 1-phenyl-5-mercaptotetrazole | 10 mg |
| 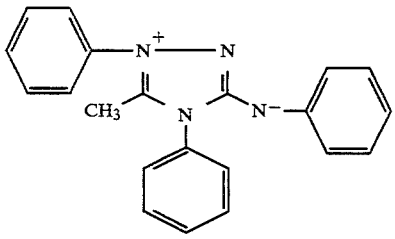 | 60 mg |
| 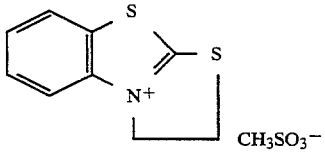 | 35 mg |

The additives applied to a protective layer solution were as follows. The amounts added thereby will be indicated by an amount per liter of a coating solution used.

| | |
|---|---|
| Lime-treated inert gelatin | 69 g |
| Acid-treated gelatin | 2 g |
| Polyacrylamide (having an average molecular weight of 50,000) | 20 g |
| Sodium i-amyl-n-decyl sulfosuccinate | 0.3 g |
| Polymethyl methacrylate (a matting agent having an area average grain size of 3.5 μm) | 1.1 g |
| Silica dioxide (a matting agent having an area average grain size of 1.2 μm) | 0.5 g |

-continued

| | |
|---|---|
| Rudox AM (colloidal silica manufactured by DuPont) | 30 mg |
| An aqueous 40% glyoxal solution | 1.5 ml |
| $(CH_2{=}CHSO_2CH_2)_2O$ | 500 mg |
| $C_{11}H_{25}CONH(CH_2CH_2O)_5H$ | 2.0 g |
| 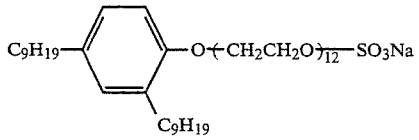 | 1.0 g |
| 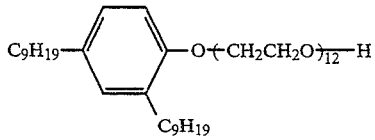 | 0.4 g |
| $NaO_3S{-}CH(CH_2COOCH_2(C_2F_4)_3H)COOCH_2(C_2F_4)_3H$ | 0.5 g |

The compositions of the developer and fixer used therein will be shown below.

| (Developer) | |
|---|---|
| Potassium sulfate | 70 g |
| Hydroxyethyl ethylenediamine | 15 g |
| Trisodium triacetate | 8 g |
| 1,4-dihydroxybenzene | 28 g |
| Boric acid | 10 g |
| 5-methyl benzotriazole | 0.04 g |
| 1-phenyl-5-mercaptotetrazole | 0.01 g |
| Sodium metabisulfite | 5 g |
| Acetic acid (90%) | 13 g |
| Triethylene glycol | 15 g |
| 1-phenyl-3-pyrazolidone | 1.2 g |
| 5-nitroindazole | 0.2 g |
| Potassium bromide | 4 g |
| 5-nitrobenzoimidazole | 1 g |

The above-given compositions were prepared to be 1.0 liter of an aqueous solution and the pH thereof was adjusted to 10.5. Before making use of the solution, 3 g of potassium bromide and 4 ml of glacial acetic acid each per 1.0 liter of the solution were added as the starter and, when making a running start, the resulting solution was filled in a developer tank to be used.

| (Fixer) | |
|---|---|
| Ammonium thiosulfate | 130 g |
| Sodium sulfite, anhydrous | 7.3 g |
| Sodium acetate trihydrate | 25.8 g |
| Aluminium sulfate, 18 hydrate | 14.6 g |
| Sulfuric acid (50 wt %) | 6.77 g |
| Boric acid | 7 g |
| Acetic acid | 15.0 g |

The above-given compositions were prepared to be 1.0 liter of an aqueous solution and the pH thereof was adjusted to 4.40.

Films were each developed in the following processing steps through a roller-transport type automatic processor (Model SRX-502 manufactured by Konica Corp.) capable of developing them for 45 seconds in the total processing time.

| Processing step | Processing temp.(°C.) | Processing time (sec.) | Amount replenished |
|---|---|---|---|
| Inserting film | — | 1.2 | |
| Developing + cross-over | 35 | 14.6 | 260 ml/m$^2$ |
| Fixing + cross-over | 33 | 8.2 | 600 ml/m$^2$ |
| Washing + cross-over | 25 | 7.2 | 3.5 l/sec. |
| Squeezing | 40 | 5.7 | |
| Drying | 45 | 8.1 | |
| Total | — | 45.0 | |

Sensitometry

The resulting samples were sandwiched between a pair of fluorescent intensifying screen KO-250 (manufactured by Konica Corp.) and was then exposed to X-rays having a tube voltage of 90 KVP and a current of 20 mA, for 0.05 seconds. A sensitometry was made based on a distance method, so that the resulting sensitivity was determined. The sensitivity value thereof was obtained in terms of the reciprocal of the X-ray dose necessary for obtaining a density of fog+1.0. The results thereof are indicated by a sensitivity relative to the sensitivity obtained of Sample No. 1 that was regarded as a standard value of 100.

Evaluation of Drying Property

The sample was so exposed to rays as to obtain the maximum density and was then developed through the foregoing automatic processor. The drying speed of the developed film was evaluated by touching the film at the dried film exit.

Evaluation

Grade 1: Completely dried up;
2: Dried, but cold;
3: Somewhat wet (not more than $\frac{1}{3}$); and
4: Wet (not less than $\frac{2}{3}$)

Evaluation of Scratch Resistance

The sample was allowed to stand for one hour under the conditions of 25° C. and 30% RH. It was loaded by 100 g per 2cm$^2$ by making use of a Nylon brush under the same conditions as above and was then scrubbed at a speed of 2 cm per second. After the thus-treated and unexposed sample was processed with an automatic processor, the numbers of the resulting blacked scratched streaks were counted.

Evaluation of Color Tone of Developed Silver

After the sample was exposed to rays so as to obtain a post-developed transmittance density of 1.2, it was developed through the foregoing automatic processor. After the resulting developed sample was allowed to stand for 7 days under the conditions of 50° C. and 80% RH, it was observed through a viewing lantern, so that the resulting silver color tone was evaluated through transmitted light by the eye.

Evaluation

Grade 1: Neutral black;
2: Slightly reddish black;
3: Reddish black; and
4: Yellowish black The results thereof will be shown in Table 1 below.

TABLE 1

| Sample No. | Emulsion | Fine-grained AgI | Sensitivity | Drying speed | scratched streak in number | Silver tone | Remarks |
|---|---|---|---|---|---|---|---|
| 1 | I | Not added | 100 | 2 | 46 | 2 | Carrp. |
| 2 | I | Added | 120 | 2 | 73 | 2 | Comp. |
| 3 | II | Not added | 100 | 1 | 18 | 3 | Comp. |
| 4 | II | Added | 120 | 1 | 20 | 1 | Inv. |
| 5 | III | Added | 120 | 1 | 19 | 1 | Inv. |
| 6 | IV | Not added | 115 | 2 | 58 | 4 | Comp. |
| 7 | IV | Added | 125 | 2 | 92 | 4 | Comp. |
| 8 | V | Not added | 115 | 1 | 27 | 4 | Comp. |
| 9 | V | Added | 125 | 1 | 24 | 2 | Inv. |
| 10 | VI | Added | 125 | 1 | 26 | 2 | Inv. |

Comp.: Comparison
Inv.: Invention

As is apparent from Table 1, the invention can provide every excellent characteristic in sensitivity, drying speed, scratch resistance and developed silver tone.

EXAMPLE 2

Preparation of Emulsion

By making use of Seed Emulsion T-1 prepared in Example 1, the grains were grown up in the following manner.

Seed Emulsion (T-1) was dispersed in an aqueous gelatin solution being kept at 40° C. and pH of the dispersion was adjusted to be 9.7 with aqueous ammonia and acetic acid. To the resulting solution, an aqueous ammoniacal silver nitrate solution and an aqueous potassium bromide and potassium iodide solution were added in a double-jet method.

In the course of the above-mentioned addition, the pAg and pH thereof were controlled to be 7.3 and 9.7, respectively, so that a silver iodobromide phase having a silver iodide content of 35 mol% could be formed.

Next, the pH thereof was varied from 9.0 to 8.0 while the pAg was kept at 7.3. In the course of growing the seed grains, an aqueous potassium bromide solution was added through a nozzle for 8 minutes and the pAg was changed to be 11.0. Three minutes after completing the addition of the potassium bromide, ripening of the mixture was completed. Successively, the pH was lowered down to 6.0 with acetic acid and sodium 5,5'-dichloro-9-ethyl-3,3'-di-(3-sulfopropyl)oxacarbocyanine anhydride was added in an amount of 400 mg/mol of AgX. After a desalting treatment was carried out with an aqueous Demol N (manufactured by Kao-Atlas Co.) solution and an aqueous magnesium sulfate solution were each added, an aqueous gelatin solution was so added as to make a redispersion.

In the above-described procedures, monodisperse type silver iodobromide emulsion (F-1) comprising grains of tetradecahedral form having roundish corners was prepared, having an average grain size of 0.3 μm, a variation coefficient ($\sigma/\gamma$) of 0.16 and an average silver iodide content of 1.5 mol%, respectively. A silver iodobromide emulsion (F-2) was prepared by the growth from Seed Emulsion T-2 in the same manner as in the emulsion (F-1), except that desalting treatment was carried out by using the same modified gelatin derivative as used in the preparation of the emulsion (T-2). A silver iodobromide emulsion (F-3) was prepared by the growth from Seed Emulsion T-3 in the same manner as in the emulsion (F-1), except that desalting was carried out using the same compound (P-1) as in emulsion (T-3).

Preparation of Samples

To each of the resulting emulsions (F-1, 2 and 3), chloroauric acid, sodium thiosulfate and ammonium thiocyanate were each added in optimum amounts, so that a chemical ripening treatments were each carried out. Thirty minutes before completing the ripening treatments, the fine-grained silver iodide prepared in Example 1 was added in an amount of $8\times10^{-4}$ mols/mol of AgX and then the following sensitizing dye A was successively added in an amount of 30 mg/mol of AgX. Thereafter, 4-hydroxy-6-methyl-1,3,3a,7-tetrazaindene was added in an amount of $3\times10^{-2}$ mol. The resulting mixture was dispersed in an aqueous solution containing 70 g of gelatin. The same additives as in Example 1 were each added in the same amounts, so that an emulsion coating solution was prepared. Further, a protective layer solution was also prepared in quite the same manner as in Example 1.

Sensitizing dye A

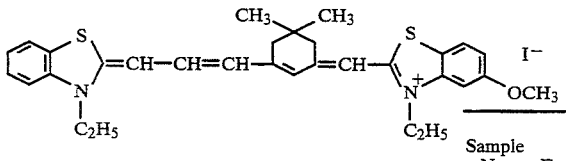

Next, for a backing layer, a backing layer coating solution was prepared by adding 400 g of gelatin, 2 g of polymethyl methacrylate, 6 g of sodium dodecylbenzene sulfonate, 80 g of the conductive polymer (P-5) given in JP OPI Publication No. 4-359244/1992 and 20 g of the following antihalation dye. And, a copolymer comprising 3 kinds of monomers, namely, 50 wt% of glycidyl methacrylate, 10 wt% of methyl acrylate and 40 wt% of butyl methacrylate, was diluted so that the concentration thereof could be 10 wt%, and the aqueous dispersion of the resulting copolymer was coated as a subbing layer coating solution, together with a protective layer coating solution comprising gelatin, a matting agent, sodium dodecylbenzene sulfonate and glyoxal, over one side of a polyethylene terephthalate base, so that a back-coated support could be prepared.

Antihalation dye

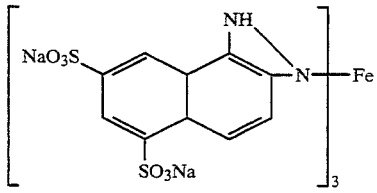

The coated amounts of the backing layer and the protective layer were 2.5 g/m² and 2.0 g/m² in terms of the gelatin amounts used.

On the foregoing back-coated base, the foregoing emulsion coating solution and the protective layer were double-coated at the same time, so that the samples were each obtained. The coated amount thereof was 3.0 g/m² in terms of the silver content. The amount of gelatin in the emulsion layer was 3 g/m² and that of the protective layer was 1.0 g/m².

On the resulting samples, the sensitometry was conducted in the following manner and the other measurements were carried out in the same manner as in Example 1, so that the drying speed, scratch resistance and developed silver tone were each evaluated.

Sensitometry

The samples were exposed through a wedge by making use of a semiconductive laser beam having a wavelength of 820 nm. The exposed samples were processed in the same procedures as in Example 1, so that the sensitivities thereof were determined. The resulting sensitivity of the sample is indicated by a sensitivity value relative to the sensitivity of Sample No. 11 which was regarded as the standard value of 100. The results thereof will be shown in Table 2.

TABLE 2

| Sample No. | Emulsion | Fine-grained AgI | Sensitivity | Drying speed | scratched streak in number | Silver tone | Remarks |
|---|---|---|---|---|---|---|---|
| 11 | F-1 | Not added | 100 | 2 | 28 | 3 | Comp. |
| 12 | F-1 | Added | 132 | 2 | 41 | 4 | Comp. |
| 13 | F-2 | Not added | 100 | 1 | 18 | 3 | Comp. |
| 14 | F-2 | Added | 130 | 1 | 17 | 1 | Inv. |
| 15 | F-3 | Added | 130 | 1 | 19 | 1 | Inv. |

Comp.: Comparison
Inv.: Invention

As is apparent from the results shown in Table 2, it was proved that every one of the sensitivity, drying speed, scratch resistance and silver tone was excellent, even when the invention is applied to a light-sensitive material applicable to a semiconductive laser beam having a spectral sensitizability in an infrared region.

What is claimed is:

1. A silver halide photographic light-sensitive material comprising a support having thereon a silver halide emulsion layer containing a silver halide emulsion comprising silver iodobromide grains or Silver iodochlorobromide grains, which is prepared by a process comprising (i) forming the silver halide emulsion by mixing a silver salt and a halide salt in a dispersion medium, (ii) subjecting the emulsion formed to washing to remove water-soluble salts, and then (iii) carrying out chemical sensitization of the emulsion wherein in (ii), the washing is carried out by coagulating the emulsion by a gelatin coagulant selected from a modified gelatin or a polymeric coagulant represented by the following formula (I); and in (iii), silver iodide fine grains having an average size of 0.2 μm or less, are added in an amount of $1\times10^{-2}$ to $1\times10^{-6}$ mole per mole of silver halide at a time during the course of the chemical sensitization, formula (I)

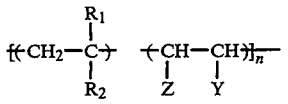

wherein $R_1$ and $R_2$ are each an alkyl group having 1 to 8 carbon atoms; Z and Y represent each —COOM, —$COOR_3$ or —$CON(R_4)(R_5)$ in which M is a hydrogen atom, an alkali metal atom or ammonium group, $R_3$ is an alkyl group having 1 to 20 carbon atoms or an aryl group, and $R_4$ and $R_5$ are each a hydrogen atom, an alkyl group having 1 to 20 carbon atoms, or an aryl group; and n is an integer of 10 to $10^4$.

2. The silver halide photographic material of claim 1, wherein said modified gelatin has not less than 50% of amino groups having an acyl group, a carbamoyl group, a sulfonyl group or a thiocarbamoyl group based on the total amino groups contained in the gelatin molecule.

3. The silver halide photographic material of claim 2, wherein said modified gelatin has not less than 50% of amino groups having an acyl group or a carbamoyl group based on the total amino groups contained in the gelatin molecule.

4. The silver halide photographic material of claim 1, wherein said silver halide fine grains are added at a time within a period from the time after adding a chemical sensitizer to the emulsion to the time before completing chemical sensitization.

5. The silver halide photographic material of claim 1, wherein said silver halide emulsion comprises silver iodobromide grains.

* * * * *